US011980331B2

(12) United States Patent
Stroop et al.

(10) Patent No.: US 11,980,331 B2
(45) Date of Patent: May 14, 2024

(54) TROLLEY AND METHOD FOR LOADING AND UNLOADING CLEANING ROBOTS INTO AND OUT OF A TROLLEY

(71) Applicant: Miele & Cie. KG, Guetersloh (DE)

(72) Inventors: Nicolas Stroop, Bielefeld (DE); Mathis Budke, Bielefeld (DE)

(73) Assignee: MIELE & CIE. KG, Gütersloh (DE)

( * ) Notice: Subject to any disclaimer, the term of this patent is extended or adjusted under 35 U.S.C. 154(b) by 0 days.

(21) Appl. No.: 17/735,447

(22) Filed: May 3, 2022

(65) Prior Publication Data

US 2022/0346620 A1 Nov. 3, 2022

(30) Foreign Application Priority Data

May 3, 2021 (BE) ..... 2021/5350

(51) Int. Cl.
*A47L 11/40* (2006.01)

(52) U.S. Cl.
CPC ..... *A47L 11/4091* (2013.01); *A47L 11/4011* (2013.01); *A47L 2201/022* (2013.01); *A47L 2201/024* (2013.01)

(58) Field of Classification Search
CPC ..... A47L 9/0063; A47L 9/009; A47L 9/2823; A47L 11/4005; A47L 11/4011;
(Continued)

(56) References Cited

U.S. PATENT DOCUMENTS 5,899,469 A * 5/1999 Pinto ..... B60B 33/026 280/47.35
2003/0221797 A1* 12/2003 Schaller, Jr. ..... E06B 9/08 160/133

(Continued)

FOREIGN PATENT DOCUMENTS

CN 109431394 A * 3/2019 ..... A47L 11/28
CN 110934544 A * 3/2020 ..... A47L 11/24

(Continued)

OTHER PUBLICATIONS

Translation of CN-110934544-A (Year: 2020).*

(Continued)

*Primary Examiner* — Steven M Cernoch
*Assistant Examiner* — Steven Huang
(74) *Attorney, Agent, or Firm* — Dickinson Wright PLLC

(57) ABSTRACT

A trolley and method for loading and unloading cleaning robots into a trolley, including for storing, emptying and supplying energy to cleaning robots. The trolley includes an energy supply unit, storage compartments, each storage compartment having a charging contact which is designed to be contacted with a cleaning robot arranged in the corresponding storage compartment to supply the cleaning robot with energy, transport wheels configured to move the trolley over a substrate, a suction system having a foldable suction platform configured to empty one of the cleaning robots arranged on the suction platform, a lift system with a foldable receiving element configured to transport the cleaning robots individually by way of the receiving element in its unfolded state to the storage compartments and away from the storage compartments, and at least one door element configured to close or expose the foldable receiving element and the foldable suction platform.

14 Claims, 4 Drawing Sheets

(58) Field of Classification Search
CPC ..... A47L 11/4091; A47L 11/4094; A47L 2201/02; A47L 2201/022; A47L 2201/024; A47L 2201/028
See application file for complete search history.

(56) References Cited

U.S. PATENT DOCUMENTS

| | | | | |
|---|---|---|---|---|
| 2012/0013907 | A1* | 1/2012 | Jung | A47L 9/28 356/438 |
| 2014/0203776 | A1* | 7/2014 | Ireland | A47L 9/2873 320/109 |
| 2016/0183752 | A1* | 6/2016 | Morin | A47L 9/2842 15/340.1 |
| 2018/0368312 | A1* | 12/2018 | Strang | A47L 9/2805 |
| 2020/0214518 | A1* | 7/2020 | Richardson | B62B 3/005 |
| 2020/0329933 | A1* | 10/2020 | Hackert | A47L 9/1454 |

FOREIGN PATENT DOCUMENTS

| | | | | |
|---|---|---|---|---|
| CN | 211796228 | U * | 10/2020 | |
| CN | 112006609 | A * | 12/2020 | |
| CN | 114343484 | A * | 4/2022 | |
| DE | 102019101116 | A1 * | 7/2020 | A47L 11/4011 |
| DE | 102019110539 | A1 | 10/2020 | |

OTHER PUBLICATIONS

Translation of CN-112006609-A (Year: 2020).*
Translation of DE-102019101116-A1 (Year: 2020).*
Translation of CN 114343484 A (Year: 2022).*
Translation of CN 211796228 U (Year: 2020).*
Translation of CN 109431394 A (Year: 2019).*
Belgium Search Report dated Feb. 10, 2022.

* cited by examiner

TROLLEY AND METHOD FOR LOADING AND UNLOADING CLEANING ROBOTS INTO AND OUT OF A TROLLEY

RELATED APPLICATIONS

The present disclosure claims priority to and the benefit of Belgium Application 2021/5350 filed on May 3, 2021, the entire contents of which are incorporated herein by reference.

TECHNICAL FIELD

The disclosure relates to a trolley and a method for loading and unloading robots into and out of the trolley. In particular, the disclosure relates to a trolley for storing cleaning robots and a method for loading and unloading cleaning robots into and out of the trolley.

BACKGROUND

In particular, for cleaning larger commercial floor areas such as retail areas in fashion stores, a cleaning system is used that has a fleet of multiple autonomous or self-propelled cleaning robots and one or more base stations that are designed to empty and supply power to the cleaning robots. The following problems arise here: During the non-active cleaning time, when the cleaning robots are not performing any cleaning tasks, a fleet or the individual cleaning robots of the fleet together with their base station(s) take up a lot of space. In the commercial application context, this high space requirement of the cleaning system is problematic. In retail areas in particular, every occupied square meter represents a direct intervention in the profitability of the business in question. In addition, the appearance of the goods can be adversely affected by the robots standing around. There is also a risk that robots will be stolen or damaged outside of the active cleaning time.

DE 10 2019 110 539 A1 discloses a cleaning station in the form of a robot for transporting self-propelled cleaning robots with a drive device for autonomous movement across a floor surface. The robot has a sensor device for detecting its surroundings, a storage device for the cleaning robots and a movement device for moving the cleaning robot, which device is designed in such a way that it can pick up one of the cleaning robots from the floor surface and place it in the storage device of the robot. The disadvantage here is that the robot cannot easily be pushed manually to a place of use. In particular, it is not possible to transport this robot over multiple floors without an elevator. The flexibility and diversity of use of the robot is severely restricted as a result. In addition, the robot is very expensive and therefore not well suited for use in the cost-sensitive cleaning industry.

SUMMARY

The disclosure therefore faces the problem of providing a cleaning station that has a high degree of flexibility and diversity of use with the simplest operation, is inexpensive, and whose cleaning robots are protected from external influences during inactivity.

According to the disclosure, this problem is solved by a trolley having the features of patent claim 1 and a method having the features of patent claim 11. Advantageous refinements and developments of the disclosure result from the following dependent claims.

The advantages that can be achieved with the disclosure are that the cleaning robots are safely stored in the trolley and protected from external influences by a door. In addition, the trolley is inexpensive because it can be moved manually using the hand grip. Electrical drive devices are not necessary to move the trolley. As a result, the trolley is inexpensive and can be easily and flexibly brought to the place of use by cleaning staff. The repositioning of the trolley does not require any multiport robot special operating skills. In addition, the trolley is less susceptible to errors such as software problems. Information on position and direction relates to an operational set-up or working position of the trolley.

The disclosure relates to a trolley for storing, emptying, cleaning and supplying energy to cleaning robots, having

- an energy supply unit that is designed to be connected to a power grid,
- storage compartments for storing the cleaning robots, each storage compartment having a charging contact which is designed to be contacted with a cleaning robot arranged in the corresponding storage compartment in order to supply the cleaning robot with energy by means of the energy supply unit,
- transport wheels which are designed to move the trolley over a substrate,
- a suction system which has a foldable suction platform and is designed to empty one of the cleaning robots when it is arranged on the suction platform,
- a lift system with a foldable receiving element, wherein the lift system is designed to transport the cleaning robots individually by means of the receiving element in its unfolded state to the storage compartments and away from the storage compartments, and
- at least one door element which can be arranged in such a way that it closes or exposes the foldable receiving element and the foldable suction platform.

The following advantages are generated by the simple, manual mobility of the trolley by a user from one place of use to another: Increased flexibility and diversity of use of the cleaning system, better transportability of the trolley, since the cleaning system is light, compact and maneuverable. In addition, a reduction in the costs of the trolley is achieved since no complex navigation technology or software has to be installed and/or used in the trolley. Easier operation of the trolley is provided such that no robotics knowledge is required to move the trolley to the place of use. The trolley is easy to understand and self-sufficient. Cleaning staff with little knowledge can handle the trolley. In addition, there is a reduction in the susceptibility to errors of the cleaning system, in particular of the trolley, due to software problems, for example, since little highly complex technology and/or software is used. The trolley has good robustness, which reduces the trolley's susceptibility to external influences such as impacts. In addition, the trolley does not require damageable navigation elements.

Together with outer walls of the trolley, the door element forms a housing which, when the door element is closed, completely encloses the interior of the trolley. The cleaning robots stored in the trolley, the storage compartments, the lift system and the suction platform are then completely encased. The door element protects the individual cleaning robots against theft or damage from external influences during storage in the trolley.

The trolley serves as a base station for a number of cleaning robots. Together with the cleaning robots, the trolley forms a cleaning system in the form of a mobile cleaning station. A fleet of multiple cleaning robots is stored inside the mobile trolley outside of the cleaning phase in which the cleaning robots perform cleaning tasks. The trolley has a number of storage compartments corresponding to the number of cleaning robots, in which the cleaning robots are stored outside of the cleaning phase and which each have their own charging contact for supplying energy to the cleaning robot stored in it.

The trolley has an energy supply unit which is designed to supply the trolley and the cleaning robots stored in it with electrical energy. In other words, the energy supply unit is designed to supply electrical energy to all of the components of the trolley and also to the energy storage units of the cleaning robots. The trolley can have a mains connection for charging the energy supply unit. If necessary, the mains connection can be easily disconnected from the power grid when the trolley is to be moved to a place of use. Alternatively or additionally, the energy supply unit is arranged in and/or on the trolley in the form of a rechargeable battery. The energy supply unit then enables a cleaning operation which is largely self-sufficient from existing connections of a building's power supply network. In addition, in the case of a rechargeable battery, the omission of a mains connection cable, which would otherwise be required, increases the degree of mobility of the trolley. In addition, the use of a rechargeable battery as an energy supply unit can be advantageous because commercial areas usually have a manageable number of sockets and the trolley can be positioned freely on the surface to be cleaned and is not constrained to local sockets. In this way, the most sensible position on the surface to be cleaned can be selected in terms of efficient use of the cleaning robot fleet.

The charging contact is preferably connected to a corresponding contact on the cleaning robot located in the storage compartment when the cleaning robot is arranged in the storage compartment. The energy storage unit of the cleaning robots is charged via the connected charging contacts when the robots are arranged in their respective storage compartments. The charging device can bring about contactless charging of the energy storage unit of the cleaning robot. Manually initiated charging of each individual cleaning robot is not necessary.

The suction system is designed to remove dirt from the cleaning robots that results from their cleaning operation. This can be superficial dirt on the housing of the cleaning robots. In addition, the suction system can be designed to clean dirt from the sensors and cleaning elements of the cleaning robots. Such cleaning functions are preferably integrated into the foldable suction platform. Furthermore, the suction system is designed to empty dirt containers of the cleaning robots, in which the cleaning robots collect dirt picked up during the cleaning operation.

The trolley preferably has a dirt collection container in which the dirt sucked out of the cleaning robots is collected. The dirt collection container is preferably detachably connected to the trolley so that it can be removed from it if required. It is preferably provided with a handle for removal from the trolley. The suction system preferably contains a fan, which is designed to generate an air flow when activated, by means of which the cleaning robots can be emptied. The suction system preferably has a suction opening that is integrated into the suction platform and a suction channel that connects the suction opening to the dirt collection container.

As a result, one of the cleaning robots can be emptied by means of a suction flow generated by the fan when it is positioned on the suction platform.

The cleaning robots that can be stored and transported in the trolley according to the disclosure are preferably suction and/or wiping robots, more preferably suction robots that are autonomous and self-propelled. Preferably at least two, preferably at least 3 to 15, more preferably 4 to 10 cleaning robots can be stored in the trolley, i.e. can each be positioned in a storage compartment.

The trolley can be easily moved using the transport wheels. In order to get to a place of use, it is sufficient for a user to push it there. In a preferred embodiment, the trolley also has a hand grip by means of which the trolley can be moved as a whole using the transport wheels. This further simplifies moving the trolley to the place of use.

The foldable suction platform and the foldable receiving element preferably lie in an unfolded state on a substrate on which the transport wheels stand, based on an operational set-up position of the trolley. The receiving element and the suction platform can preferably be folded by 90°. This can be made possible by appropriately attached hinges. The foldable suction platform and the foldable receiving element preferably lie flat on the substrate when unfolded. The foldable receiving element is preferably segmented and preferably has two receiving element segments.

The suction platform is preferably arranged between two receiving element segments and separated from them. The two receiving element segments and the suction platform are preferably dimensioned in such a way that a cleaning robot moves over the two receiving element segments with its edges and its body extends above the suction platform between the two receiving element segments. It is thus possible for the receiving element to be moved vertically in order to transport the cleaning robot, which is arranged on its wheels on the receiving element segments, to one of the storage compartments without the suction platform also having to be moved.

In a preferred embodiment, multiple or all of the storage compartments are stacked vertically one on top of the other. They are preferably mounted so that they can be detached from one another. This further saves space on a substrate on which the trolley is placed.

In a preferred embodiment, the foldable receiving element can be moved vertically in the unfolded state, based on an operational set-up position of the trolley. The lift system is designed to automatically move the receiving element vertically and has an electric motor, for example.

The trolley preferably also has a control panel which is designed in such a way that a user can operate the trolley interactively. For example, the user can use the control panel to start a cleaning mode in which the cleaning robots stored in it are unloaded from the trolley to carry out their cleaning tasks. The trolley preferably has a controller that is designed to start the cleaning mode immediately after activation. Alternatively or additionally, a timer can also be stored in the controller, which ensures that the cleaning mode can be started at a later point in time, if desired. After activating the cleaning mode, the user can leave the area to be cleaned, since the trolley and the cleaning robots now carry out the activated cleaning independently. No further work steps are necessary to start and end the cleaning, the cleaning system continues to work self-sufficiently.

The controller is preferably designed to automatically control the loading and unloading, suction and, if necessary, cleaning of the cleaning robots.

The trolley preferably also has adjustable blocking elements which are designed to block the transport wheels in a blocking state and to release the transport wheels in non-blocking state. As a result, the trolley can be fixed on a cleaning surface so that accidental bumping and/or sliding of the trolley during cleaning operation is prevented. By blocking the transport wheels of the trolley, especially during the cleaning phase, the trolley is secured against unwanted changes in position. As a result, the process by which the cleaning robots find the trolley again after completing their cleaning tasks cannot be disrupted and/or prevented. Rather, it is guaranteed that the cleaning robots find their way back to the starting point or back into the trolley. If necessary, the trolley's transport wheels can be blocked or unblocked by the user. The adjustable blocking elements are preferably attached to mechanical blocking elements. The blocking elements are preferably designed in such a way that they can be fixed or released by the user's foot. This makes it easier to handle.

In a preferred embodiment, the trolley also has a lock which is designed to secure the door element. This further protects the cleaning robots against theft or damage from external influences. Unauthorized opening of the trolley and stealing of the cleaning robots by unauthorized persons is still prevented.

The door element is preferably designed in such a way that it can be opened and closed manually. The door element is preferably designed as a sliding door which can be slid into a space between an outer wall and an inner space of the trolley. The trolley can have guide rails between the inner space and the outer walls to assist in sliding the sliding doors. As a result, the open trolley takes up less space than if it had hinged doors. The door element preferably has one or more handles, with the aid of which the front of the trolley in the form of the door element can be opened in the form of two sliding doors which can be slid outwards.

In a further embodiment, the door element can be opened and closed automatically. For example, the door element can be opened automatically by operation via the control panel. The door element can continue to be automatically lockable via the control panel. In a further embodiment, the door element is automatically closed by means of the trolley controller after all cleaning robots have been loaded into the trolley at the end of the cleaning phase. In a preferred embodiment, the trolley has one or more electric motors which are designed to automatically open and close the door element.

Preferably, the suction platform and/or the receiving element can be unfolded and folded in automatically. This is preferably also implemented via one or more electric motors.

The trolley preferably has electronic components, such as an infrared interface IR, which are designed to support a cleaning robot arranged on the suction platform or the receiving element in positioning itself correctly on it for suction.

The trolley preferably has a communication system for exchanging data with the cleaning robots. In a preferred embodiment, the communication system of the trolley is designed for wireless data transmission, for example as a WLAN or Bluetooth module. In a further embodiment, the communication system can be designed to exchange data with an external electrical device that is used to control and/or monitor the trolley. Such an external device can be, for example, a personal computer, a smartphone, a smartwatch or a tablet.

The trolley is preferably of modular construction. That is, it has a modular architecture. As a result, it does not always have to be transported and used as a whole, but a needs-based, modular adjustment of the number of cleaning robots used and thus a reduction and/or increase in capacity is possible. This increases again the diversity of use of the trolley. The trolley preferably has expansion modules, which can each be placed on the storage compartment that is located at the highest vertical height and can be fixed there with the aid of fasteners. The expansion modules each have a storage compartment including charging contact elements and fasteners, with the lift system on the trolley being adaptable to the new situation by expanding its end position. The trolley can thus be expanded to accommodate n cleaning robots to n+x cleaning robots with x expansion modules if the size or requirements of the floor area to be cleaned should change or if the trolley is used on different surfaces with different requirements. Furthermore, the transport of the trolley is simplified, since the total volume and weight can be reduced through the targeted removal of expansion modules. This is particularly advantageous when transporting the system across different floors without an elevator.

The trolley can have a LiDAR reflector or a beacon such as an IR beacon. As a result, the trolley makes it easy for the cleaning robots to find it again.

Furthermore, the disclosure relates to a method for loading and unloading cleaning robots into and out of a trolley with storage compartments for storing the cleaning robots, a lift system with a foldable receiving element for receiving one of the cleaning robots and moving the received cleaning robot, and a door element that closes or exposes the receiving element, the method having the following steps:

- opening the door element so that the receiving element is exposed,
- unfolding the receiving element so that it rests on a substrate on which the trolley is standing in an operational set-up position, and
- moving the receiving element after a cleaning robot has been placed on it to one of the storage compartments, so that the storage compartment can be accessed by the cleaning robot in order to load one of the cleaning robots into the trolley, or
- moving the receiving element by means of the lift system to one of the storage compartments in order to enable a cleaning robot arranged in this storage compartment to be placed on the receiving element, and moving the receiving element after receiving this cleaning robot, so that the element rests on the substrate and the cleaning robot is enabled to leave the trolley independently in order to unload the cleaning robot out of the trolley,
- repeating the steps of moving the receiving element until a predetermined number of the cleaning robots are loaded into or unloaded out of the trolley.

The embodiments and advantages described for the trolley apply correspondingly to the method and vice versa.

Outside of the cleaning phase, i.e., when the cleaning robots are not performing a cleaning task, they are stowed or stored in the trolley. At the start of the cleaning phase, the trolley starts to unload the individual cleaning robots onto the surface to be cleaned. For this purpose, the robots are automatically brought out of the storage compartments one after the other onto the substrate to be cleaned with the help of the movable lift system. While the cleaning tasks are being carried out, the individual cleaning robots on the trolley can be sucked empty, cleaned and/or temporarily charged.

For suction and, if necessary, cleaning, the cleaning robot in question drives onto the suction platform, positions itself there and is sucked empty via the suction system of the trolley, with the suction flow for emptying the cleaning robot being generated by the fan. At the same time, additional cleaning functions can be performed on the cleaning robot by the suction platform. These include, for example, functions such as cleaning brush rollers, sensors or similar devices of the cleaning robot. For intermediate charging, the cleaning robot in question is brought into a free storage compartment with the help of the movable lift system. Intermediate charging takes place in the storage compartment via the existing charging contact. After charging is complete, the cleaning robot is brought back to the substrate to be cleaned via the lift system in order to continue its cleaning task. In an alternative embodiment, a quick-charging module is arranged on the suction platform, which is set up to quickly charge a cleaning robot during emptying and/or cleaning.

When a cleaning robot finishes its cleaning task, it returns to the trolley. To do this, the cleaning robot must find the trolley: If the cleaning robot had an existing map at its disposal at the start of the cleaning, the current position of the trolley was defined as the starting point in this map, so that the cleaning robot can find the trolley itself in order to be loaded. If no map was available when the cleaning started, the position of the trolley should be set as the zero point of a map newly created by the cleaning robot. In addition, the trolley can emit the beacon such as the IR beacon, which enables the cleaning robots to precisely locate and approach the trolley. The cleaning robots are loaded into the trolley using the movable lift system. The cleaning robot is preferably subjected to suction and, if necessary, the cleaning process, prior to being loaded so that the cleaning robot is stored empty and clean in one of the storage compartments of the trolley.

Once all cleaning robots have been stored in the trolley after completing their cleaning tasks, the user can remove it from the surface to be cleaned. To do this, the user folds the foldable receiving element of the lift system and the foldable suction platform in again and closes the door element, which can preferably be locked.

If necessary, at the end of the cleaning phase, the dirt collection container of the suction system can be removed and emptied, for example using the handle.

After receiving a particular signal from the cleaning robot that its particular cleaning task has been carried out, and after it has been arranged on the receiving element, the receiving element is preferably moved in order to transport the cleaning robot arranged on it to one of the storage compartments.

BRIEF DESCRIPTION OF THE DRAWINGS

An exemplary embodiment of the disclosure is shown purely schematically in the drawings and will be described in more detail below. They show, schematically and not to scale.

DETAILED DESCRIPTION OF THE DRAWINGS

Figure 1:
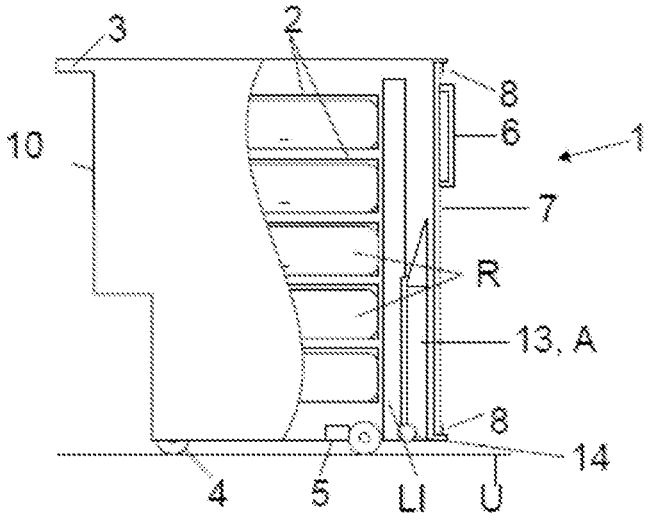
FIGS. 1 to 8: a sequence of part of a method according to the disclosure in partial side/partial cross-sectional view, partial top/partial cross-sectional view and cross-sectional view of a trolley according to the disclosure.

FIGS. 1 to 8 show a sequence of part of a method according to the disclosure, in which one of the cleaning robots stored in the trolley is unloaded at the beginning of a cleaning phase in which the cleaning robots carry out cleaning tasks, in a partial side/partial cross-sectional view, partial top/partial cross-sectional view and cross-sectional view of a trolley according to the disclosure.

FIGS. 1 to 8 show the unloading of one of the cleaning robots R from the trolley 1, comprising a step of opening the door element 7 so that the receiving element 12 and the suction platform 13 are exposed, a step of unfolding the receiving element 12 and the suction platform 13, so that they rest on a substrate U on which the trolley 1 is standing in an operational set-up position, and moving the receiving element (12) by means of the lift system LI to one of the storage compartments 2 in order to enable a cleaning robot R arranged in this storage compartment 2 to be placed on the receiving element 12, and moving the receiving element 12 after receiving this cleaning robot R, so that the element rests on the substrate U and the cleaning robot R is enabled to leave the trolley 1 independently in order to unload the cleaning robot R out of the trolley 1. In a cleaning phase in which the cleaning robots R carry out cleaning tasks, the step of moving the receiving element 12 is repeated until a predetermined number of the cleaning robots R have been unloaded from the trolley.

When the cleaning phase has ended, the cleaning robots are loaded back into the trolley by repeatedly moving the receiving element after one of the cleaning robots has been placed on it to one of the storage compartments, so that the storage compartment can be accessed by the cleaning robot, which is not shown here. Then the suction platform and the receiving element are folded in manually or automatically and the door element is closed, which is not shown here. The cleaning phase is essentially ended in the reverse order to the unloading of the cleaning robots R from the trolley 1 shown in FIGS. 1 to 8.

FIG. 1 shows a partial side/partial cross-sectional view of a trolley according to the disclosure prior to the start of unloading one of the cleaning robots stored in the trolley. The trolley 1 has outer walls 10, between which a plurality of storage compartments 2 stacked vertically one above the other are accommodated, in each of which one of the cleaning robots R is stored. The trolley 1 also has transport wheels 4, which are designed to move the trolley 1 in the operational set-up position over a substrate U, with the trolley 1 also having adjustable blocking elements 5 which are designed to block the transport wheels 4 in a blocking state and to release the transport wheels 4 in a non-blocking state. As a result, the trolley 1 is fixed in the blocking state and movable in the non-blocking state. The trolley 1 has a hand grip 3 for better mobility or displaceability. The trolley 1 also has a suction system A, which has a foldable suction platform 13 and is designed to empty one of the cleaning robots R when it is arranged on the suction platform 13, which is not shown here.

In order to load and unload the cleaning robots R, the trolley 1 also has a lift system LI with a foldable receiving element (not shown). The lift system LI is designed to load the cleaning robots R individually into the storage compartments 2 and unload them out of the storage compartments 2 by means of the receiving element in its unfolded state, which is not shown here. The trolley 1 has at least one door element 7 which can be arranged in such a way that it closes or exposes the outer walls 10 by being arranged in front of the folded-in receiving element 12. In FIG. 1, the door element 7 closes the foldable receiving element 12 and the suction platform 13 so that the inside of the trolley is closed off by means of the outer walls 10 and the door element 7. The suction platform 13 can be folded by means of a hinge 14. The door element 7 is designed as two sliding doors, each of which is provided with a handle 6 and can be slid on guide rails 8, an electric motor 25 and a lock 27.

Figure 2:
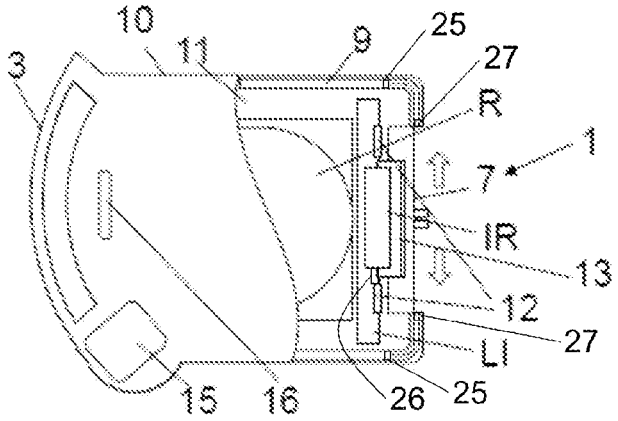

FIG. 2 shows a partial top/partial cross-sectional view of the trolley shown in FIG. 1 prior to the start of unloading one of the cleaning robots stored in the trolley. The trolley 1 has a control panel 15 via which a user (not shown) can control the trolley 1 and, for example, load and unload the cleaning robots R into and out of the trolley 1. The trolley 1 also has a handle 16. By pulling on the handle 16, a dirt collection container (not shown) of the suction system (not shown) can be removed from the trolley 1 for emptying dirt collected in it. The door element 7 is designed as the two sliding doors which can be slid into a space 9 between an outer wall 10 and an inner space 11 of the trolley 1 by means of the guide rail (not shown), as indicated by arrows. Furthermore, the trolley 1 has an infrared interface IR, which is designed to support a cleaning robot R arranged on the suction platform 13 in positioning itself correctly on it for suction.

Figure 3:
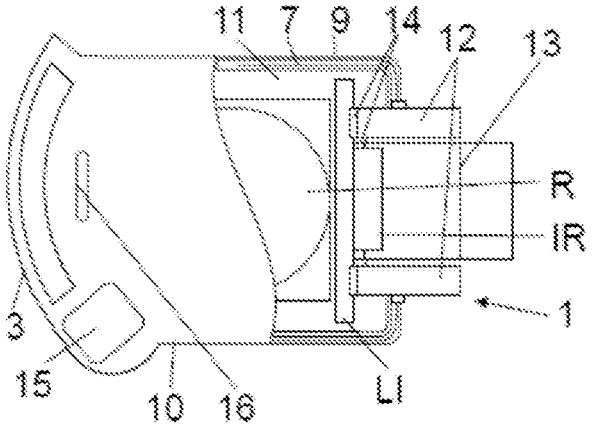

FIG. 3 shows a partial top/partial cross-sectional view of the trolley shown in FIG. 1 in a partially opened state. The door element 7 is located in the space 9 between the outer wall 10 and the inner space 11. As a result, the receiving element 12 and the suction platform 13 are exposed. They can now be unfolded automatically by means of an electric motor 26 or manually by a user (not shown) by means of the hinge 14; they are partially unfolded in FIG. 3. The receiving element 12 is segmented. The suction platform 13 is arranged between two receiving element segments of the receiving element 12.

Figure 4:
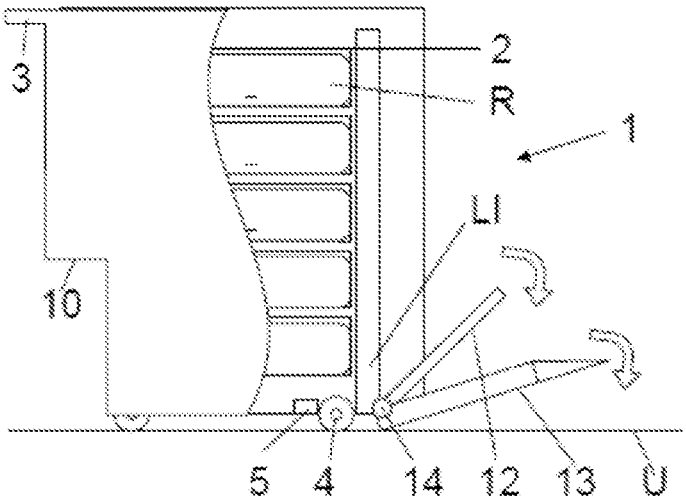

FIG. 4 shows a partial side cross-sectional view of the trolley shown in FIG. 3 in the partially opened state. The suction platform 13 and the receiving element 12 are partially unfolded in the direction of the arrows. The blocking elements 5 are shown in a non-blocking state in which they do not block the transport wheels 4. However, they can also be in a blocking state in which they block the transport wheels 4. Both the suction platform 13 and the receiving element 12 are each provided with a hinge 14.

Figure 5:
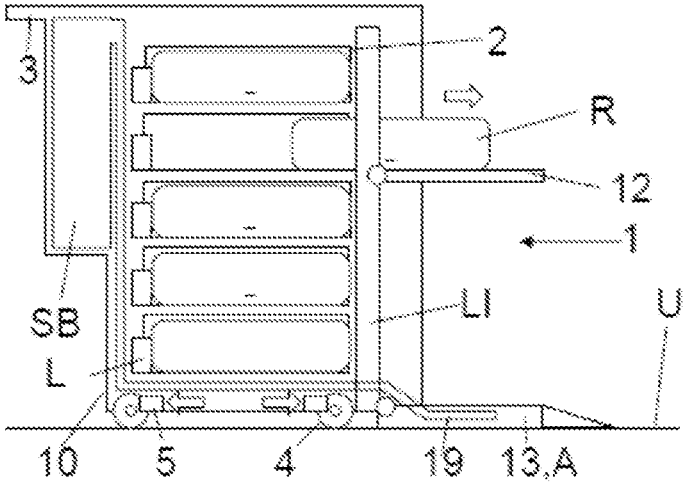

FIG. 5 shows a cross-sectional view of the trolley shown in FIG. 1 in an opened state. The suction platform 13 rests on the substrate U, while the receiving element 12 is moved vertically by means of the lift element LI to one of the storage compartments 2, in which a cleaning robot R to be loaded is stored, which moves in the direction of the arrow from the storage compartment 2 onto the receiving element 12. The blocking elements 5 are in the blocking state, as indicated by arrows, to fix the trolley 1 in its position. The suction system A has a dirt collection container SB for collecting dirt sucked out of cleaning robots R by means of the suction system A and a suction channel, which connects the dirt collection container to the suction platform 13 and opens into an opening (not shown) formed in the suction platform 13. The suction system also has a fan (not shown) which, when activated, generates an air flow so that dirt is sucked out of a cleaning robot R arranged on the suction platform 13 via the suction channel 19 into the dirt collection container SB. Each storage compartment 2 has a charging contact L, which is designed to be contacted with a cleaning robot R arranged in the corresponding storage compartment 2 in order to supply the cleaning robot R with energy by means of an energy supply unit (not shown) of the trolley (1).

Figure 6:
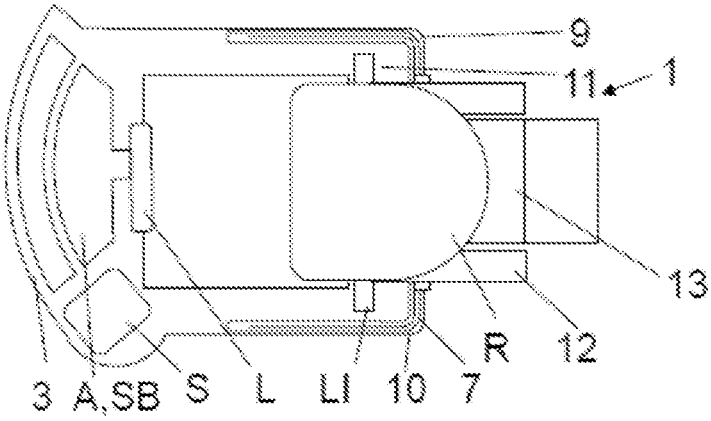

FIG. 6 shows another cross-sectional view of the trolley shown in FIG. 5 in the opened state. The trolley 1 has a controller S which is designed to control the loading and unloading of the cleaning robots R and their suction process.

Figure 7:
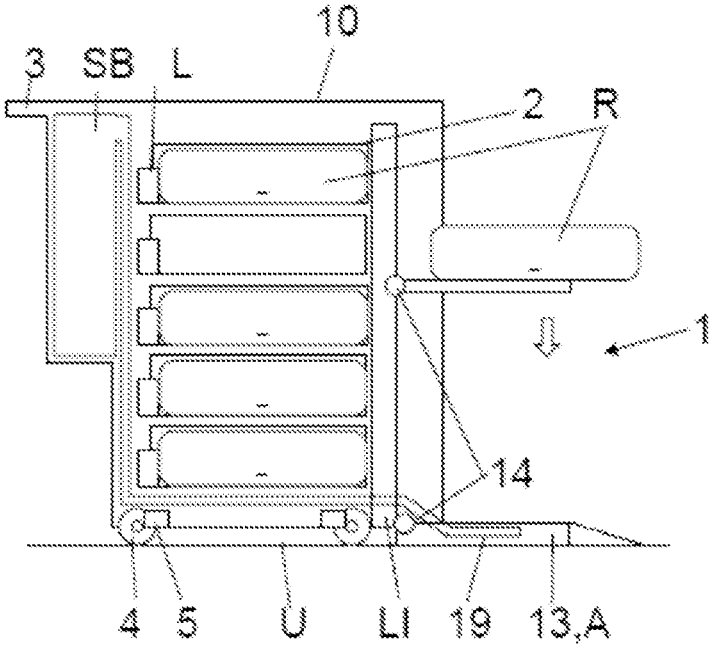

FIG. 7 shows another cross-sectional view of the trolley shown in FIG. 6 in a further opened state. The receiving element 12 is moved vertically in the direction of the substrate U with the cleaning robot R arranged on it, as indicated by an arrow.

Figure 8:
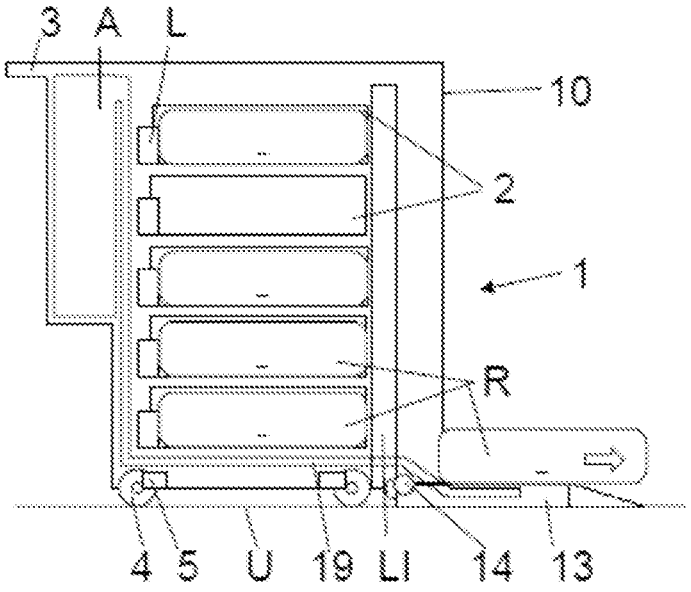

FIG. 8 shows another cross-sectional view of the trolley shown in FIG. 7 in a still further opened state. The receiving element (not shown) now rests on the substrate U, so that the cleaning robot R can leave the trolley 1 by moving in the direction of the arrow.

Figure 9:
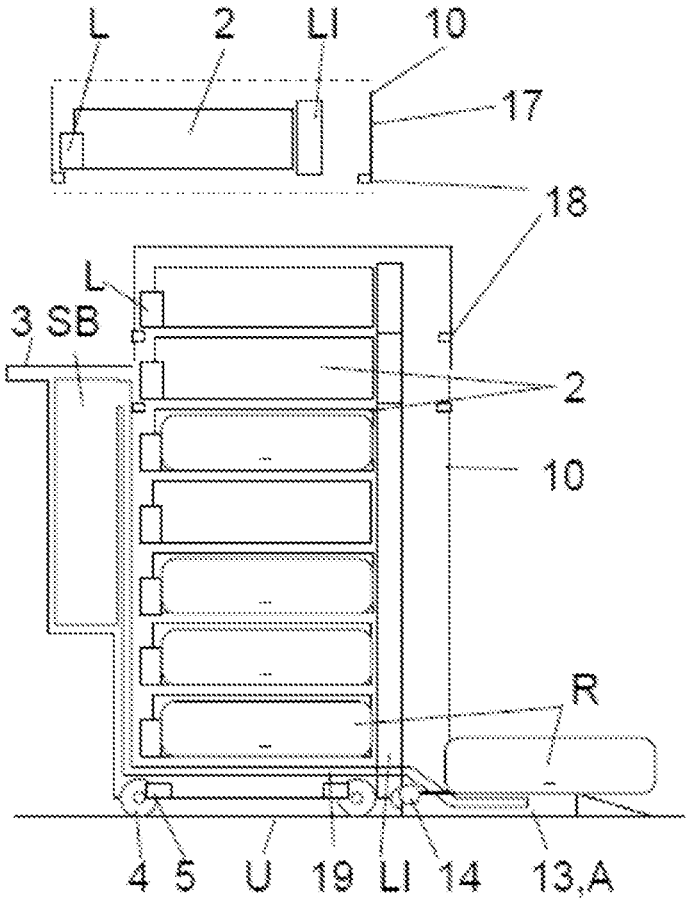
FIG. 9: a cross-sectional view of another trolley according to the disclosure.

FIG. 9 shows a cross-sectional view of a further trolley according to the disclosure. The trolley shown in FIG. 9 corresponds to the trolley shown in FIG. 8 with the difference that it also has expansion modules 17. Each expansion module 17 has fasteners 18 for connecting the expansion module 17 to the trolley 1, a storage compartment 2 including charging contact L and an extension of the lift system LI, which are arranged in parts of outer walls 10 so that the expansion module 17 can be attached to the top storage compartment 2 of the trolley 1 and connected by means of fasteners 18.

REFERENCE LIST

A suction system
IR infrared interface
L charging contact
LI lift element
R cleaning robot
SB dirt container
U substrate
1 trolley
2 storage compartment
3 hand grip
4 transport wheel
5 blocking element
6 handle
7 door element
8 guide rail
9 space
10 outer wall
11 inner space
12 receiving element
13 suction platform
14 hinge
15 control panel
16 further handle
17 expansion module
18 fastener
19 suction channel

The invention claimed is:

1. A trolley for storing, emptying and supplying energy to cleaning robots, the trolley comprising:

an energy supply unit that is designed to be connected to a power grid;

storage compartments for storing the cleaning robots, each storage compartment having a charging contact which is designed to be contacted with a cleaning robot arranged in the corresponding storage compartment in order to supply the cleaning robot with energy by means of the energy supply unit;

transport wheels which are designed to move the trolley over a substrate;

a suction system, which has a foldable suction platform and is configured to empty one of the cleaning robots when it is arranged on the suction platform in its unfolded state;

a lift system with a foldable receiving element, the foldable receiving element being segmented to define two receiving element segments, wherein the lift system is designed to transport the cleaning robots individually by way of the receiving element in an unfolded state to the storage compartments and away from the storage compartments, wherein the suction platform is located between the two receiving element segments in the unfolded states of the suction platform and receiving element; and at least one door element which can be arranged in such a way that it closes or exposes the foldable receiving element and the foldable suction platform.

2. The trolley according to claim 1, further comprising a hand grip configured such that the trolley can be moved as a whole using the transport wheels.

3. The trolley according to claim 1, wherein the foldable suction platform and the foldable receiving element lie in the unfolded state on a substrate on which the transport wheels stand, based on an operational set-up position of the trolley.

4. The trolley according to claim 1, wherein multiple or all of the storage compartments are stacked vertically one on top of the other, and wherein the storage compartments are mounted so that they can be detached from one another, based on an operational set-up position of the trolley.

5. The trolley according to claim 1, wherein the foldable receiving element can be moved vertically in the unfolded state, based on an operational set-up position of the trolley.

6. The trolley according to claim 1, further comprising a control panel configured that a user can operate the trolley interactively.

7. The trolley according to claim 1, further comprising adjustable blocking elements configured to block the transport wheels in a blocking state and to release the transport wheels in a non-blocking state.

8. The trolley according to claim 1, further comprising a lock designed to secure the door element.

9. The trolley according to claim 1, wherein the door element is designed as a sliding door which can be slid into a space between an outer wall and an inner space of the trolley.

10. The trolley according to claim 1, further comprising one or more electric motors configured to automatically open and close the door element and/or automatically unfold and fold in the suction platform and/or the receiving element.

11. The trolley according to claim 1, wherein, in their unfolded states, the two receiving element segments have a height less than a height of the foldable suction platform.

12. The trolley according to claim 1, wherein, in their unfolded states, the foldable suction platform projects further away from the storage compartments than the foldable receiving element of the lift system.

13. The trolley according to claim 1, wherein the foldable suction platform includes a ramp portion, and wherein the foldable receiving element does not project beyond the ramp portion in the unfolded state of the foldable receiving element.

14. The trolley according to claim 1, wherein the foldable suction platform is foldable independently of the foldable receiving element.

* * * * *